United States Patent [19]

O'Neil et al.

[11] 4,129,227

[45] Dec. 12, 1978

[54] ECOLOGY POP-IN CONTAINER TOP

[76] Inventors: Theodore K. O'Neil; George Spector, both c/o George Spector, 3615 Woolworth Bldg., 233 Broadway, New York, N.Y. 10007

[21] Appl. No.: 887,875

[22] Filed: Mar. 17, 1978

[51] Int. Cl.[2] ..... B65D 41/32

[52] U.S. Cl. ..... 220/267; 220/277

[58] Field of Search ..... 220/267, 268, 269, 277; 222/80, 81, 83, 541

[56] References Cited

U.S. PATENT DOCUMENTS 3,726,432 4/1923 Gentile ..... 220/267 X 4,018,357 4/1977 Ostrem ..... 220/277 X

*Primary Examiner*—George T. Hall

[57] ABSTRACT

An improved beverage can in which a hole is punched in the can top, so to allow drinking from the can, a scored tab of the hole being pushed down into the can and out-of-the-way instead of being torn off and tossed on the ground; the can in one design including a slide having attached "lock-in legs" which, when depressed, break the tab scoring, and when held-down slide is then pushed, it causes the tab to curl up inwardly into the can; and the slide in another design thereof including means to also roll the soft edges downward into the can so to prevent cutting the lips of a drinker.

4 Claims, 25 Drawing Figures

10
3
12
11
3

12
16
20
11
16
10
19

12
21
11
10
13
14
17
18

12
21
13

12
21
10
19
13

12
21
9
9
13
15

21

21
21
15
15

ECOLOGY POP-IN CONTAINER TOP

This invention relates generally to beverage cans such as are used for holding soft drinks or beer in a quantity for individual drinking. However, it is also adaptable to non-drinking containers.

At the present time such cans are being made so that a tab on a top end thereof can be torn off and tossed away so to form a hole for allowing a person to drink therefrom. This is objectionable, because much of the drinking directly from the cans is done out-of-doors such as at sports events, or while riding in a car. In all this and other such situations the torn off tab is tended to be simply thrown on the ground so that it pollutes the environment. This, accordingly, is in want of an improvement.

Therefore, it is a principal object of the present invention to provide an improved beverage can in which a tab, formed by making the can opening, is not torn off, but remains connected to the can by being pushed inwardly and rolled up out-of-the-way.

Another object, accordingly, is to provide an improved beverage can which rolls down the edges of the drinking opening so to prevent a drinker to cut his lips thereon.

Other objects are to provide an improved begerage can which is simple in design, inexpensive to manufacture, rugged in construction, easy to use and efficient in operation.

These and other objects will be readily evident upon a study of the following specifications and the accompanying drawing wherein.

Figures 1, 2, 3, 4, 5, 6, 7, 8, 9, 9A, 9B, 10:
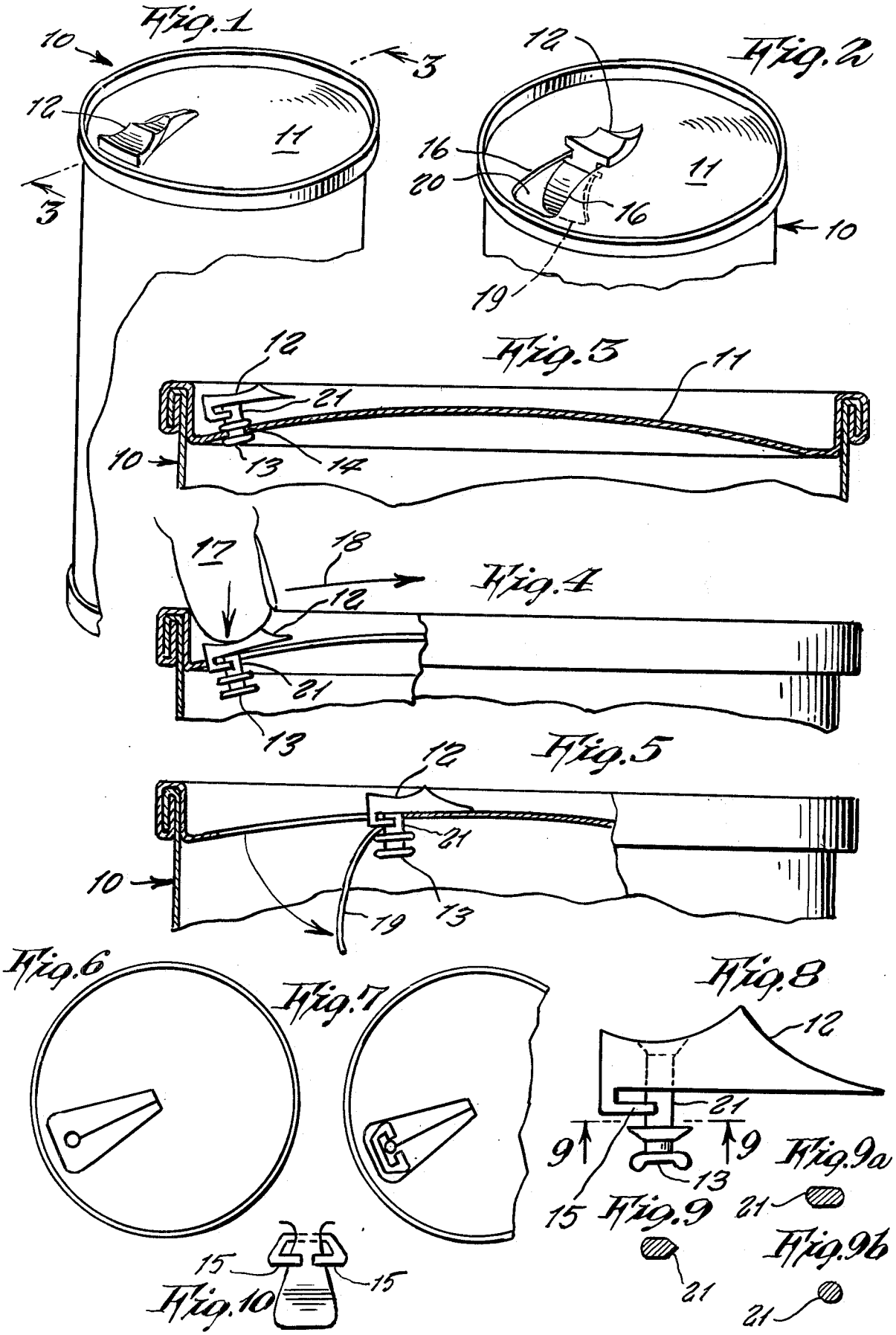
FIG. 1 is a perspective view of one design of the invention shown prior to use in opening the can.
FIG. 2 shows the opener in position after opening the can.
FIGS. 3, 4 and 5 are cross sectional view on line 3—3 of FIG. 1 and illustrate successive steps in opening the can.
FIG. 6 is a top view of the scored lines on the can end.
FIG. 7 shows placement of the lock-in retainer legs on the unopened can.
FIG. 8 is a side view of the slidable opener.
Figure 11:
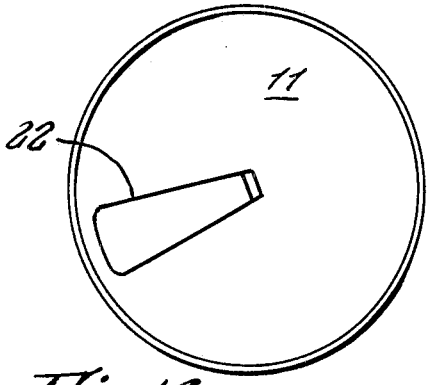
Figure 12:
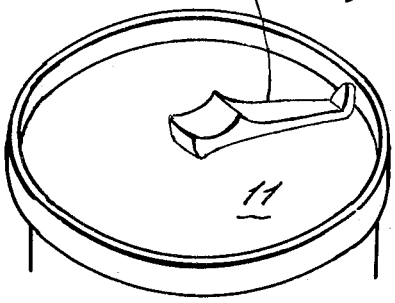
Figure 13:
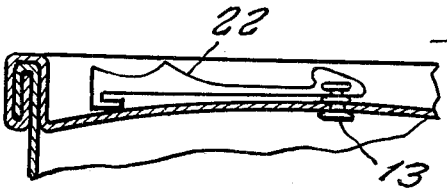

FIGS. 9*a* and 9*b* are modified designs of the structure shown in FIG. 9.

FIG. 10 illustrates the lock-in retainer legs locked around the depressed tab.

FIGS. 11 through 19 are views generally the same as above described FIGS. 1 to 10, and illustrate a modified design of the invention.

Figure 22:
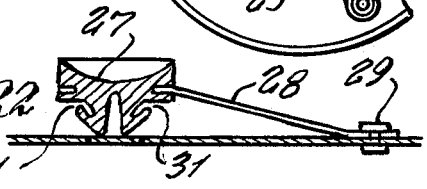

FIGS. 20, 21, 22 and 23 show still another design of the invention in which the slide opens, travels in an arc by being on a pivotable arm; the opener being designed to roll the side edges of the slot downward for still greater protection; FIG. 22 showing the scored line on the can end and FIGS. 22 and 23 being cross sections on FIG. 20.

Referring now to the drawing in detail, and more particularly to FIGS. 1 to 10 thereof at this time, the reference numeral 10 represents a beverage can according to the present invention wherein there is a circular top end wall 11 which is slightly rounded upwardly due to the can interior being pressurized.

A slide 12 is positioned above the end wall 11 and includes a downward rivet 13 integral therewith which at its lower end extends riveted in an air tight manner through an opening 14 of the end wall. An upper position of the slide includes lock-in-legs 15 that follow the score lines 16 of the end wall, so that when the slide is downwardly depressed by a FIG. 17, as shown in FIG. 4, the lock-in legs align on the score lines, and when the slide is then pushed forwardly as indicated by arrows 18 of FIG. 4, the lock-in legs then tear the can end along the score lines so to form a tab 19 therebetween that rolls of curls down inside the can as shown in FIG. 5 so to form an opening 20 in order that the beverage can be poured therethrough out of the can.

This is the sliding rivet version of the invention.

The slide may be made of metal, molded nylon or plastic, or else degradeable materials.

The design of the upper shank of the rivet is important as it holds and orients the direction of the slide, and also, when depressed, is the cutting edge 21 of the center rivet guide scoring on the tab, as shown in FIGS. 6, 7 and 10.

In a fixed rivet version of the invention, illustrated in FIGS. 11 through 19, the external slide 22, when depressed, causes the lock-in legs to break the outer edges of the scoring. When held down and pushed forward, the legs cause the tab to be curled inward and the legs to lock into place around the bent in tab. Here also the design of the upper shank of the rivet is important as it orients the placement of the slide correctly over the tab of the unopened can and guides the slide when opening. Depending on the length of the slide, the rivet should be placed slightly beyond over the top center of the can end.

Figure 19:
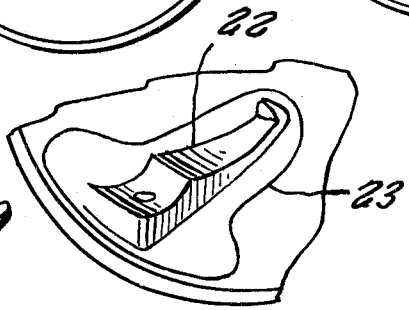

In FIG. 19, a thin plastic, nylon or other synthetic protective shield 23 may also be used on either the sliding rivet or fixed rivet versions of the invention as shown.

Figure 16:
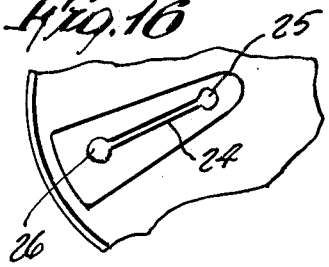
Figure 14:
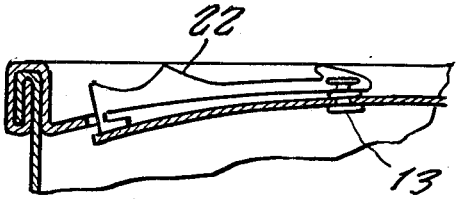
Figure 15:
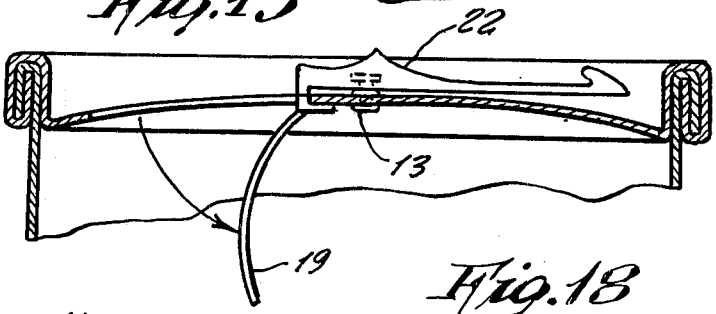
Figure 20:
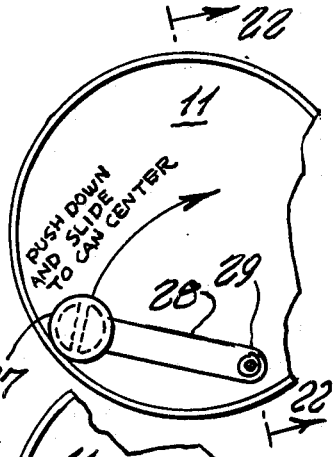
Figure 17:
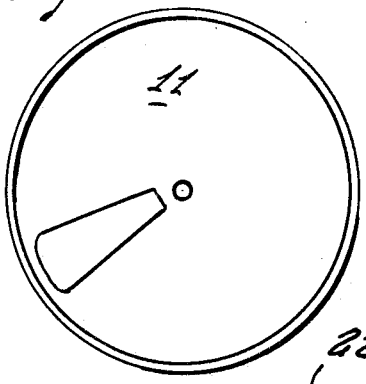
Figure 18:
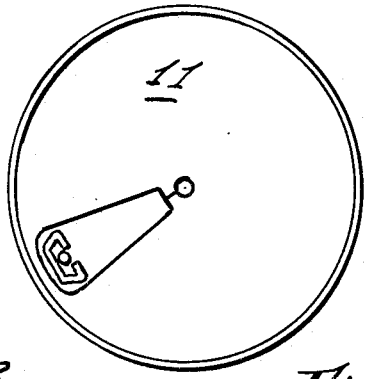
Figure 21:
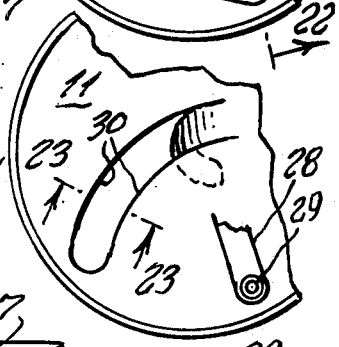

FIG. 16, shows a rivet slide 24 with location 25 for the rivet prior to can opening and a position 26 after being opened.

Figure 23:
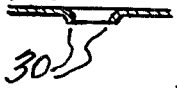

In FIGS. 20 to 23, illustrates still another design of the invention in which a slide 27 is at one end of an arm 28 that pivots on a rivet 29 at its other end, which is affixed through the can end wall. Thus the slide travels on an arcuate path (after being pushed down through the can), so to curl the tab as stated above. The slide as shown in FIG. 22 causes the edges 30 of the slot to be held in downwardly inclined grooves 31 of the slide as the slide travels, so that the edges 30 are thus rolled downwardly into the can so to hide the raw edges 30, as shown in FIG. 23, and keep them away from being contacted by a drinker's lips.

The above described lock-in-legs may also be incorporated in the design shown in FIGS. 20 to 23.

While various changes may be made in the detail construction, it is understood that such changes will be within the spirit and scope of the present invention as in defined by the appended Claims.

What is claimed is:

1. An ecology pop-in container, comprising in combination a beverage can having an upward rounded top end wall, a slide mounted externally of said top end wall, said slide being carried on a downward rivet riveted through said top end wall, said slide having a pair of lock-in-legs attached thereto, and means on said slide for rolling down side edges of a beverage pouring opening made by said slide.

2. The combination as set forth in claim 1, wherein said rivet includes an upper shank portion that guides in a tab groove scored in said can end wall, and said slide is affixed to said rivet to serve as a sliding rivet therefore.

3. The combination as set forth in claim 1, wherein said rivet is affixed stationarily through a center portion of said can end wall, and said slide slides on said rivet which serves as a fixed rivet therefore.

4. The combination as set forth in claim 1, wherein said means comprises said slide being on one end of an arm pivotable at its other end about a stationary second rivet mounted through said can top wall, and said opening edge rolling means comprises inclined on an underside of said slide receiving said opening edges.

* * * * *